US007654688B2

(12) United States Patent
Li et al.

(10) Patent No.: US 7,654,688 B2
(45) Date of Patent: Feb. 2, 2010

(54) LED LAMP WITH AN IMPROVED HEAT SINK

(75) Inventors: Hao Li, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 48 days.

(21) Appl. No.: 12/024,966

(22) Filed: Feb. 1, 2008

(65) Prior Publication Data

US 2009/0154160 A1 Jun. 18, 2009

(30) Foreign Application Priority Data

Dec. 14, 2007 (CN) ..... 2007 1 0125124

(51) Int. Cl.
*F21V 21/00* (2006.01)
*F21V 29/00* (2006.01)

(52) U.S. Cl. ..... 362/240; 362/373; 362/145; 362/549; 362/294; 362/382

(58) Field of Classification Search ..... 362/249, 362/800, 240, 373, 145, 147, 549, 650, 294, 362/382

See application file for complete search history.

(56) References Cited

U.S. PATENT DOCUMENTS

| | | | | |
|---|---|---|---|---|
| 5,632,551 | A * | 5/1997 | Roney et al. | 362/485 |
| 6,502,975 | B1 * | 1/2003 | Branstetter | 362/549 |
| 6,552,658 | B1 * | 4/2003 | Roller et al. | 340/475 |
| 6,578,994 | B1 * | 6/2003 | Beyerlein | 362/490 |

FOREIGN PATENT DOCUMENTS

CN 200982565 Y 11/2007

* cited by examiner

*Primary Examiner*—Jacob Y Choi
(74) *Attorney, Agent, or Firm*—Frank J. Niranjan

(57) ABSTRACT

A recessed LED lamp for being mounted in a wall or a ceiling, includes a housing (10), a printed circuit board (20) received in the housing, a plurality of LEDs (22) mounted on the printed circuit board, a casing (40) surrounding the housing, a pair of arms (50) resiliently and pivotably attached on the casing, and a heat sink (30) secured below the housing. The heat sink includes a base (32) contacting the printed circuit board and thermally connecting therewith, a plate (34) extending outwardly from the base and a plurality of fins (36) extending downwardly from the plate (34).

18 Claims, 3 Drawing Sheets

LED LAMP WITH AN IMPROVED HEAT SINK

BACKGROUND OF THE INVENTION

1. Field of the Invention

The present invention relates to a light emitting diode (LED) lamp, and more particularly to a recessed LED lamp incorporating an improved heat sink for dissipating heat more efficiently and reducing a cost thereof.

2. Description of Related Art

As an energy-efficient light, an LED lamp has a trend of substituting the fluorescent lamp for indoor lighting purpose; in order to increase the overall lighting brightness, a plurality of LEDs are often incorporated into a signal lamp, in which how to efficiently dissipate heat generated by the LEDs becomes a challenge.

Conventionally, the LED lamp utilize a heat dissipating structure having a shape like a sunflower: a heat sink has a cylindrical post and a plurality of fins extending outwardly and radially from a circumference of the post. A bottom face of the post is used for thermally connecting with LEDs of the LED lamp. Thus, heat generated by the LEDs is conducted to the fins via the post, and dispersed to the surrounding environment from the fins.

Unfortunately, when such a conventional heat sink is used in the LED lamp, it cannot effectively dissipate heat generated by the LEDs since the LEDs act as multiple heat-generating centers, which require a heat sink with a large base to contact with the multiple heat-generating centers. However, the post of the sunflower-type heat sink cannot have a large base to contact with the LEDs due to the limitation of geometry of the cylindrical post. In addition, since in the sunflower-type heat sink, heat generated by the LEDs is firstly transferred vertically to the post and then horizontally to the fins via the post, the heat dissipating efficiency is not good enough to timely dissipate the heat generated by the LEDs.

Furthermore, the sunflower-type heat sink requires a high cost of manufacture.

What is needed, therefore, is an LED lamp with an improved heat sink which can overcome the above-mentioned disadvantages.

SUMMARY OF THE INVENTION

An LED lamp includes a housing, a printed circuit board received in the housing, a plurality of LEDs mounted on the printed circuit board, a casing surrounding the housing, a pair of arms resiliently and pivotably attached on the casing, and a heat sink secured below the housing. The heat sink includes a base contacting the printed circuit board, a rectangular plate which is larger than the base being integrally formed with and extending outwardly from a bottom face of the base and a plurality of fins extending downwardly from the plate. Heat generated by the LEDs can be conducted to the base and then to the plate. From the plate, the heat is vertically transferred to the downwardly extending fins to be dissipated to surrounding atmosphere. The base has opposite arced sides which are provided with threads for threadedly engaging with threads of the housing.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
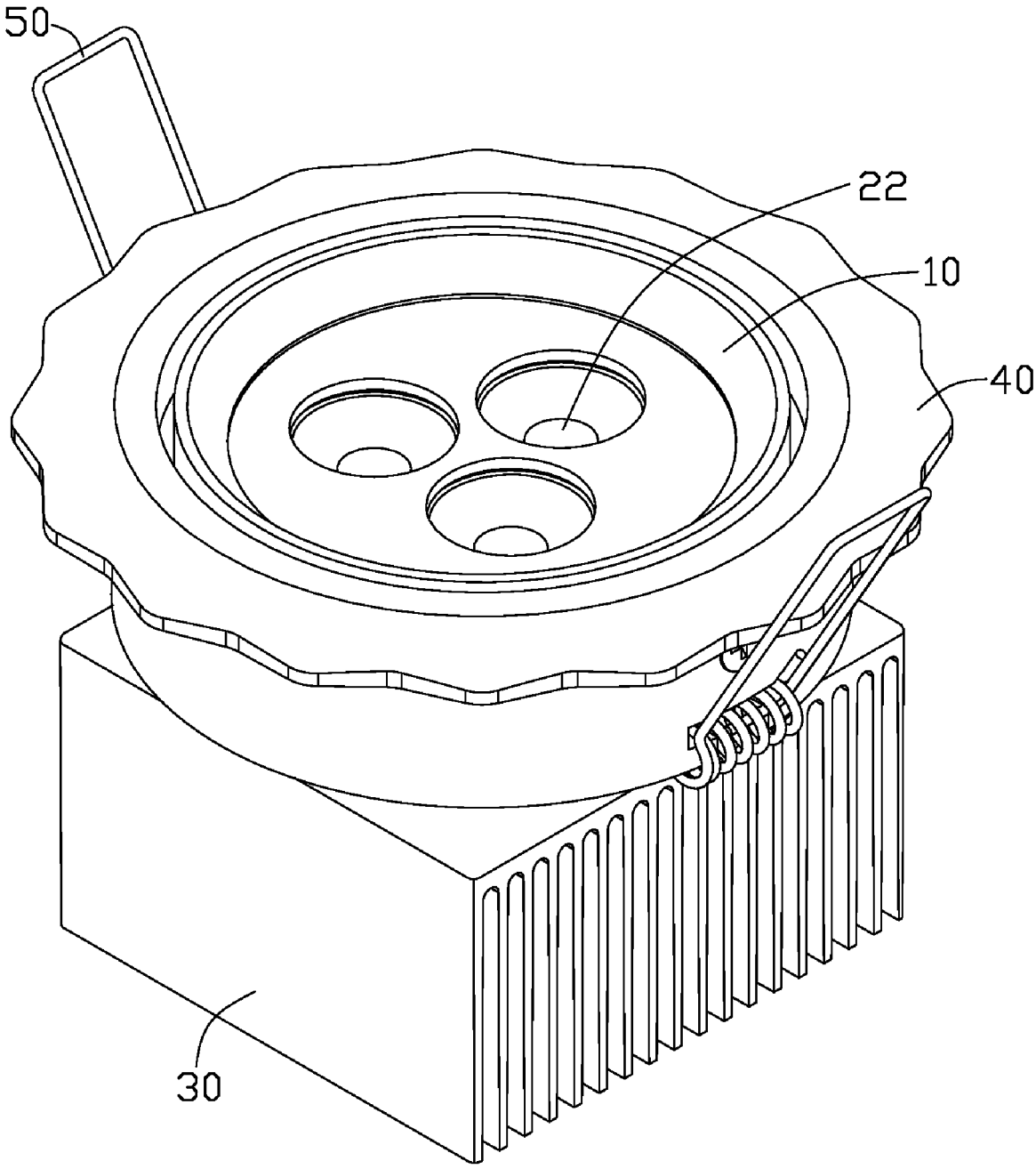
FIG. 1 is an assembled, isometric view of an LED lamp in accordance with a preferred embodiment of the present invention.
Figure 2:
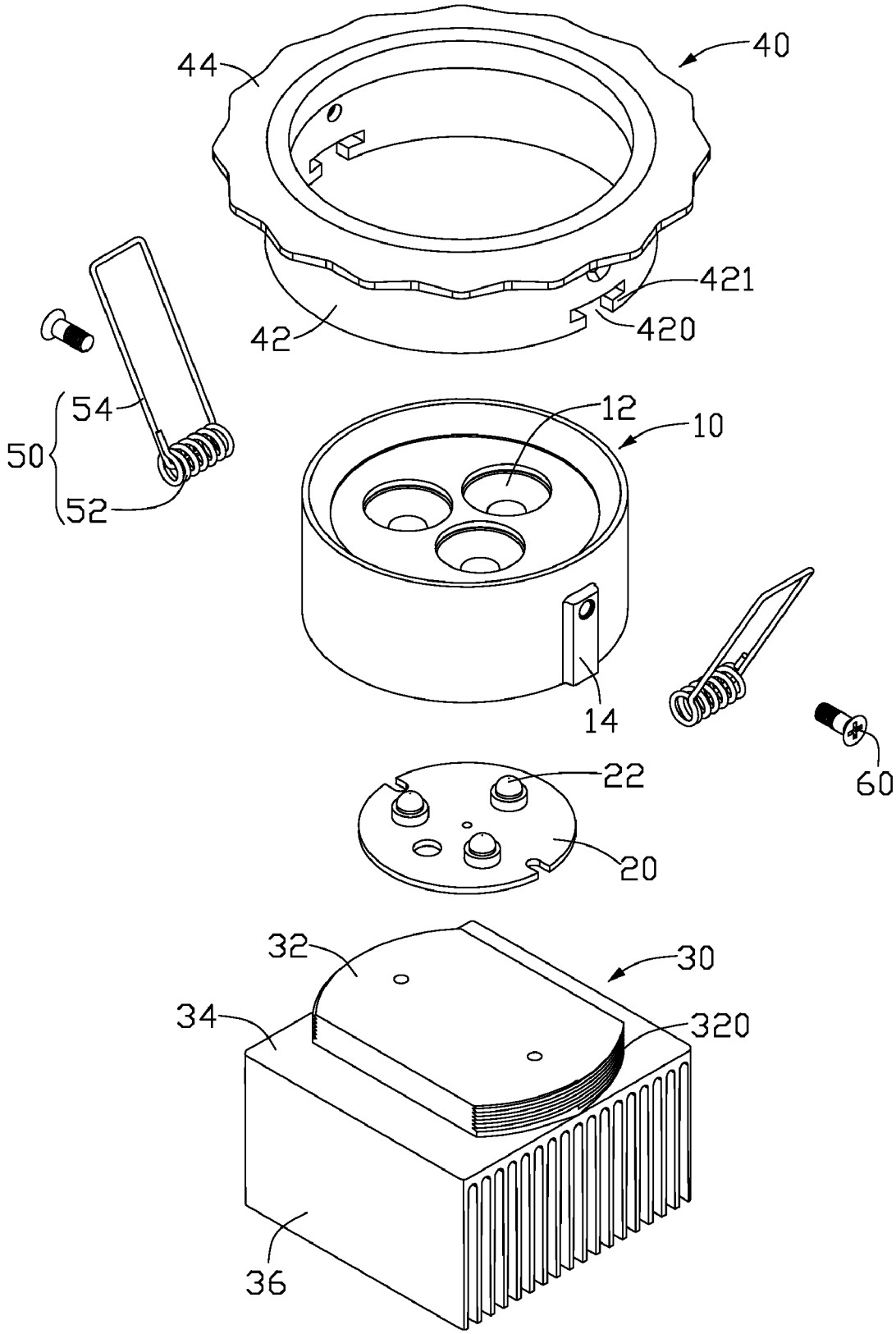
FIG. 2 is an exploded view of FIG. 1.

Referring to FIGS. 1 and 2, an LED lamp in accordance with a preferred embodiment of the present invention is used for being recessed in a wall panel of a ceiling (not shown) and projecting a light beam therefrom. Such a recessed lamp is usually used for decoration purpose in a shop or a house. The LED lamp comprises a housing 10, a printed circuit board 20 received and concealed in the housing 10, a plurality of LEDs 22 mounted on the printed circuit board 20, a heat sink 30 secured below the housing 10, a casing 40 fixed around the housing 10, and a pair of arms 50 resiliently and pivotably attached on the casing 40.

The housing 10 has a cylindrical configuration with a top face recessed downwardly to form a tapered space (not labeled). A bottom face of the tapered space defines a plurality of evenly distributed holes 12 thereon, for receiving the plurality of LEDs 22 therein. A pair of rectangular ears 14 are designed in an opposing relationship at a circumference of the housing 10, wherein each of the pair of rectangular ears 14 extends in a direction along a height of the housing 10, and has a top portion lower than the top face of the housing 10, and a bottom portion coplanar with a bottom face of the housing 10. The housing 10 is hollow and defines a large opening (viewed from FIG. 3 and it is not labeled) in the bottom face thereof. The printed circuit board 20 and a top portion of the heat sink 30 are accommodated in the opening. The opening communicates with the plurality of holes 12.

The casing 40 consists of an annular sidewall 42 surrounding the circumference of the housing 10, and a flange 44 extending outwardly and horizontally from a top of the annular sidewall 42. The annular sidewall 42 is disposed around an upper portion of the housing 10 with the flange 44 coplanar with the top face of the housing 10 (illustrated in FIG. 3). The annular sidewall 42 defines a pair of grooves 420 in a bottom portion thereof, corresponding to the pair of rectangular ears 14 of the housing 10. Each of the pair of grooves 420 is T-shaped, whereby the annular sidewall 422 forms a pair of ribs 421 located corresponding to a groove 420 and facing each other. The flange 44 is oriented perpendicular to the annular sidewall 42, with an outer periphery thereof being wave-shaped. A pair of screws 60 are brought to extend through the annular sidewall 42 and into the pair of rectangular ears 14, respectively, to thereby conveniently and firmly fix the casing 40 to the housing 10.

Each of the pair of arms 50 includes a spiral portion 52 and a rectangular portion 54 formed inclinedly from the spiral portion 52 and abutting against the outer periphery of the flange 44 of the casing 40. The spiral portion 52 is retained in a corresponding one of the pair of grooves 420 of the casing 40 by inserting the ribs 421 into the spiral portion 52, whereby the arms 50 are resiliently and pivotably attached to the annular sidewall 42 of the casing 40. The spiral portion 52 is able to provide a resilient force to the rectangular portion 54 to thereby force it returning its original position, when the rectangular portion 54 is rotated from the original position. The rectangular portion 54 is for resiliently abutting against a rear side of the wall panel or the ceiling, to thereby sandwich the wall panel or the ceiling with the flange 44 of the casing 40, which is for closely abutting against a front side of the wall panel or the ceiling, whereby the LED lamp is secured in the wall panel or the ceiling.

The plurality of LEDs 22 are distributed on the printed circuit board 20 in a triangle relationship. The printed circuit board 20 has a diameter less than that of the opening in the housing 10. The printed circuit board 20 is accommodated horizontally in the opening of the housing 10 with the plurality of LEDs 22 received within the plurality of holes 12. The LEDs 22 are visible from an outside of the LED lamp, and light generated by the LEDs 22 can emit to the outside of the LED lamp.

Figure 3:
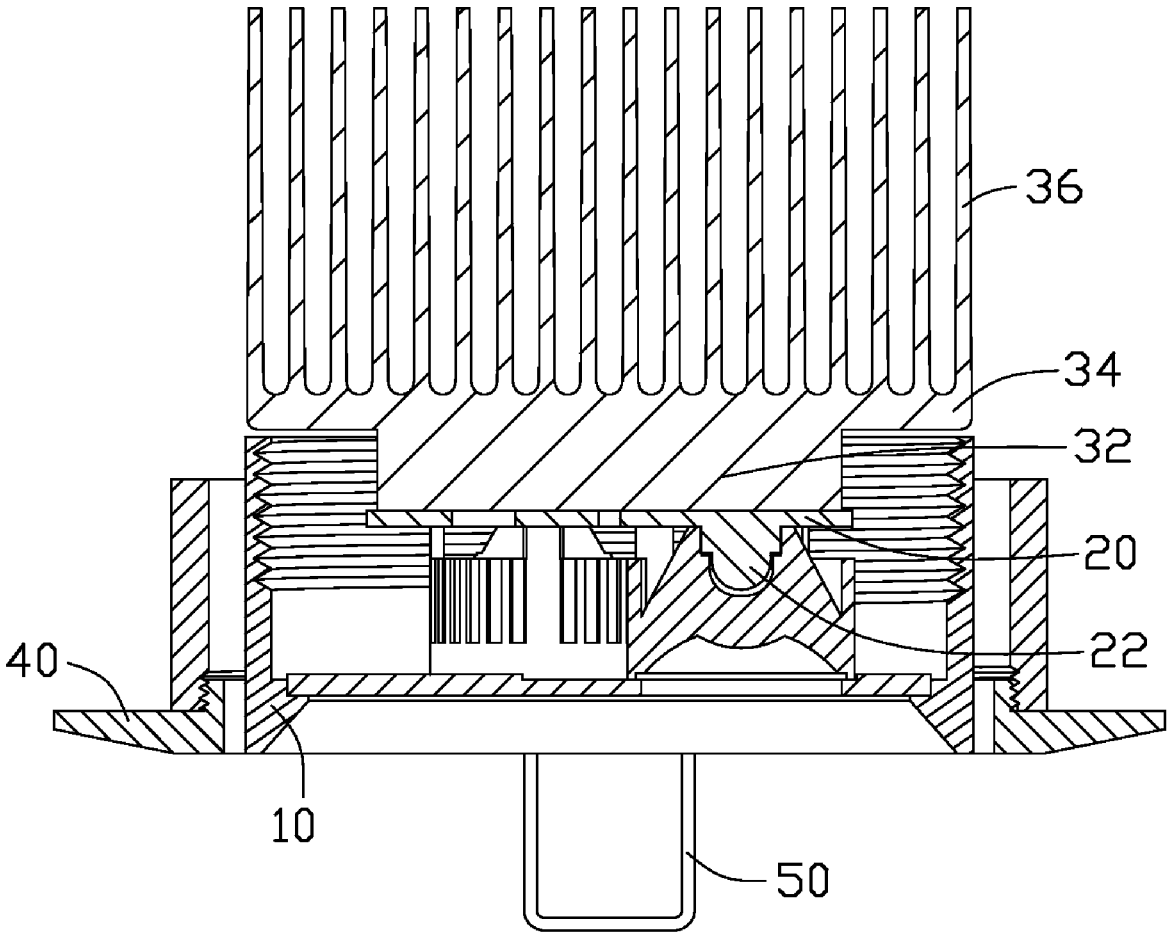
FIG. 3 is a vertically sectional view of FIG. 1, viewed from an inverted aspect.

Also referring to FIG. 3, the heat sink 30, the housing 10, the printed circuit board 20, and the casing 40 are coaxial with each other. The heat sink 30 comprises a base 32 positioned parallel to the printed circuit board 20 and perpendicular to the pair of rectangular ears 14, a plate 34 parallel to and integral with a bottom face of the base 32, and a plurality of fins 36 extending downwardly and perpendicularly from the plate 34. The plate 34 has an area larger than that of the base 32, extends outwardly from a periphery of the base 32 and is located outside of the housing 10. The base 32 has a pair of opposite flat sides (not labeled), and another pair of opposite arc-shaped sides (not labeled) each being provided with threads 320 for threadedly engaging with the housing 10, thus firmly mounting the heat sink 30 to the housing 10. An area of the base 32 is larger than that of the printed circuit board 20, whereby when the top face of the base 32 contacts the bottom face of the printed circuit board 20, heat generated by each of the plurality of LEDs 22 can be sufficiently and rapidly conducted to the base 32 via the printed circuit board 20. The plate 34 is used for more evenly transferring the heat absorbed by the base 32 to the plurality of fins 36. The plurality of fins 36 are spaced from each other with suitable distances therebetween, and occupy an entire bottom face of the plate 34, for dissipating the heat from the plate 34 to ambient air quickly.

Since all of the plurality of LEDs 22 are located within a periphery of the base 32 of the heat sink 30, the heat generated by the plurality of LEDs 22 is able to be conducted to the base 32 via the printed circuit board 20 directly. Therefore, the heat can be dissipated rapidly and sufficiently, and an overheat or a malfunction of the plurality of LEDs 22 is thus prevented. Moreover, since the heat sink 20 is provided with the plate 34 which is larger than the base 32 and integral with the base 32, the heat absorbed by the base 32 can be quickly spread to the plate 34, from which the heat is directly and downwardly transferred to the fins 36 to be dissipated to ambient air. Thus, the heat generated by the LEDs 22 can be timely dissipated to enable the LEDs 22 to work within their predetermined temperature range.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:
a housing;
a printed circuit board received in the housing;
a plurality of LEDs mounted on the printed circuit board;
a casing surrounding an upper portion of the housing;
a heat sink contacting and thermally connecting the printed circuit board, comprising:
a base contacting the printed circuit board and accommodated in a lower portion of the housing;
a plate larger than the base and integral with the base; and
a plurality of fins extending downwardly and perpendicularly from the plate to a location outside the housing;
wherein a pair of arms are resiliently and pivotably attached to the casing, and
wherein the casing comprises a flange, the pair of arms abutting against a periphery of the flange of the casing.

2. The LED lamp as claimed in claim 1, wherein the housing has a hollow cylindrical shape, the printed circuit board being received and concealed in the housing with the plurality of LEDs being received in the housing and visible from an outside of the LED lamp.

3. The LED lamp as claimed in claim 2, wherein the housing forms a pair of opposing ears at an outer periphery thereof, each of the pair of opposing ears extending along a height direction of the housing.

4. The LED lamp as claimed in claim 3, wherein the casing comprises an annular sidewall, the flange of the casing extending outwardly and perpendicularly from a top of the sidewall, the sidewall enclosing the housing with the flange coplanar with a top of the housing.

5. The LED lamp as claimed in claim 4, wherein each of the pair of arms comprises a spiral portion locked into the sidewall of the casing, and a rectangular portion inclinedly formed on the spiral portion and abutting against the flange of the casing.

6. The LED lamp as claimed in claim 2, wherein the base of the heat sink is oriented parallel to the printed circuit board, and perpendicular to an axis of the housing.

7. The LED lamp as claimed in claim 2, wherein the casing, the housing, the printed circuit board, and the heat sink are coaxial with each other.

8. The LED lamp as claimed in claim 1, wherein the base of the heat sink has a pair of opposite flat sides and a pair of opposite arced sides located between the pair of opposite flat sides, the pair of opposite flat sides and the pair of opposite arced sides cooperating to define a periphery of the base.

9. The LED lamp as claimed in claim 8, wherein each of the pair of opposite arced sides of the base forms a plurality of threads thereon for threadedly engaging with the lower portion of the housing.

10. The LED lamp as claimed in claim 1, wherein the plate of the heat sink is located outside of the housing.

11. A recessed LED lamp comprising:
a lamp fixture comprising:
a casing assembly;
a flange extending outwardly and horizontally from the casing assembly, adapted for intimately abutting against a front side of a wall;

a pair of arms fixed slantwise and pivotably attached on the casing assembly, the pair of arms abutting against a periphery of the flange and being pivotable to resiliently abut against a rear side of the wall;

a printed circuit board received in the casing assembly;

a plurality of LEDs mounted on the printed circuit board; and a heat sink secured below the casing assembly, comprising:

a base contacting the printed circuit board;

a plate extending outwardly from a bottom face of the base beyond a periphery of the base;

a plurality of fins extending downwardly from the plate.

12. The recessed LED lamp as claimed in claim 11, wherein the casing assembly of the lamp fixture defines a pair of opposing grooves in a bottom thereof, each of the opposing grooves having a T-shaped for retaining a part of a corresponding one of the pair of arms therein.

13. The recessed LED lamp as claimed in claim 11, wherein the base of the heat sink has a pair of parallel flat sides and a pair of arc-shaped sides each having a plurality of threads defined therein.

14. The recessed lamp as claimed in claim 13, wherein the threads threadedly engage with the casing assembly.

15. The recessed lamp as claimed in claim 11, wherein the plate has a rectangular shape.

16. The recessed LED lamp as claimed in claim 15, wherein the base of the heat sink is oriented parallel to the printed circuit board and the plate, and perpendicular to the plurality of fins.

17. The LED lamp as claimed in claim 11, wherein the casing assembly comprises a housing receiving the printed circuit board and the LEDs therein and a casing enclosing an upper portion of the housing, the flange being extended from the casing.

18. The LED lamp as claimed in claim 17, wherein each of the pair of arms comprises a spiral portion fixed to the casing, and a rectangular portion extending from the spiral portion and abutting against the periphery of the flange of the casing.

* * * * *